US005735246A

United States Patent [19]

Vincent et al.

[11] Patent Number: 5,735,246

[45] Date of Patent: Apr. 7, 1998

[54] FUEL SCHEDULING AS A FUNCTION OF MISFIRE RATE

[75] Inventors: Michael T. Vincent, Novi; Mark S. Borland, Birmingham; Kim A. Morehouse, Stockbridge; James R. Tamm, Ann Arbor, all of Mich.

[73] Assignee: Chrysler Corporation, Auburn Hills, Mich.

[21] Appl. No.: 723,400

[22] Filed: Sep. 30, 1996

[51] Int. Cl.[6] ..... F02D 41/14

[52] U.S. Cl. ..... 123/436

[58] Field of Search ..... 123/436, 435

[56] References Cited

U.S. PATENT DOCUMENTS 4,366,793 1/1983 Coles ..... 123/436
5,021,960 6/1991 Manaka et al. ..... 123/436
5,237,504 8/1993 Holmes et al. ..... 123/436
5,345,911 9/1994 Kadowaki et al. ..... 123/436

*Primary Examiner*—Andrew M. Dolinar
*Attorney, Agent, or Firm*—Mark P. Calcaterra

[57] ABSTRACT

A system is provided for controlling the ratio of fuel to air in an internal combustion engine to protect the catalyst substrate of a catalytic convertor from thermal damage. The system comprises detecting a misfire rate and adjusting the amount of fuel within the system accordingly. More particularly, the detected misfire rate is compared to at least one predetermined misfire rate within the engine control unit. If the detected misfire rate is not equal to the predetermined rate, the ratio of fuel to air is changed a calibrated amount. Accordingly, when the misfire rate exceeds a predetermined rate, additional fuel is added to the system. By increasing the ratio of fuel to air, the oxidation reaction is reduced and the exothermic activity within the catalytic converter is lowered.

30 Claims, 2 Drawing Sheets

FUEL SCHEDULING AS A FUNCTION OF MISFIRE RATE

BACKGROUND OF THE INVENTION

1. Technical Field

This invention generally relates to fuel systems for internal combustion engines. More particularly, the present invention relates to a system for controlling the exothermic activity in a catalytic converter as a function of engine misfire rate.

2. Discussion

It is generally known in the art of internal combustion engines that engine misfire conditions cause unignited fuel and unused oxygen to be delivered to the catalytic converter. The fuel, in the presence of the oxygen, is combusted within the catalytic converter to prevent it from being passed from the system. It is also known that increased rates of rates of oxidation reactions occur in the catalyst at higher rates of engine misfire. Accordingly, higher rates of misfire cause increased levels of exothermic activity in the catalytic converter.

The increased combustion within the catalytic converter causes the temperature of the converter, and particularly the catalyst substrate, to rise. The catalyst substrate may be damaged by exposure to temperatures beyond its material failure threshold. At extreme levels of combustion, the catalyst may become inoperative.

To prevent such damage, some manufacturers employ a warning light to notify the motor vehicle operator that a rate of misfire has developed which may cause damage if the driver does not act. However, the rate of misfire required for activating the warning signal is set artificially low to assure that sufficient time is available for the operator to seek service before excessive damage occurs. Accordingly, the warning signal is activated even though relatively low levels of misfire have developed.

In addition to warning signals, other manufacturers have configured the engine fuel system to operate at enriched levels to provide a cooling effect within the catalytic converter. In this way, a greater fuel to air ratio is maintained throughout the system under normal operating conditions and into the catalytic converter under misfire conditions. The exothermic activity within the catalytic converter is reduced by the increased ratio of fuel to air. Thus, the temperature of the catalyst substrate is maintained below its material failure threshold level for an extended period of time. However, these prior art systems employ enriched fuel systems under both normal operating conditions and misfire operating conditions. Therefore, excessive fuel is added to the system regardless of the existence of a misfire condition. Accordingly, the operator suffers a fuel economy penalty from the unnecessarily added fuel.

Therefore, it is desirable to provide a system of fuel scheduling which protects the catalytic converter from thermal damage due to increased exothermic activity under misfire conditions without sacrificing fuel economy. Thus, it is desirable to add fuel to the system only upon the development of a misfire condition. Additionally, it is desirable to provide a method of fuel scheduling which only activates a warning signal when sufficient levels of misfire have developed where damage to the catalytic converter is more likely to occur.

SUMMARY OF THE INVENTION

The above and other objects are provided by a method for controlling the ratio of fuel to air in an internal combustion engine. The method comprises detecting a misfire rate and adjusting the amount of fuel within the engine accordingly. More particularly, the detected misfire rate is compared to at least one predetermined misfire rate within the engine control unit. The ratio of fuel to air is changed a calibrated amount if the detected misfire rate is not equal to the predetermined rate. Accordingly, the oxidation reaction is reduced within the catalytic converter by adding additional fuel to the system under misfire conditions. The exothermic activity within the catalytic converter is thereby controlled and the operator does not suffer a fuel economy penalty by unnecessarily adding fuel to the system prior to a misfire condition developing.

BRIEF DESCRIPTION OF THE DRAWINGS

In order to appreciate the manner in which the advantages and objects of the invention are obtained, a more particular description of the invention will be rendered by reference to specific embodiments thereof which are illustrated in the appended drawings. Understanding that these drawings only depict preferred embodiments of the present invention and are not therefore to be considered limiting in scope, the invention will be described and explained with additional specificity and detail through the use of the accompanying drawings in which.

DETAILED DESCRIPTION OF THE PREFERRED EMBODIMENTS

Figure 1:
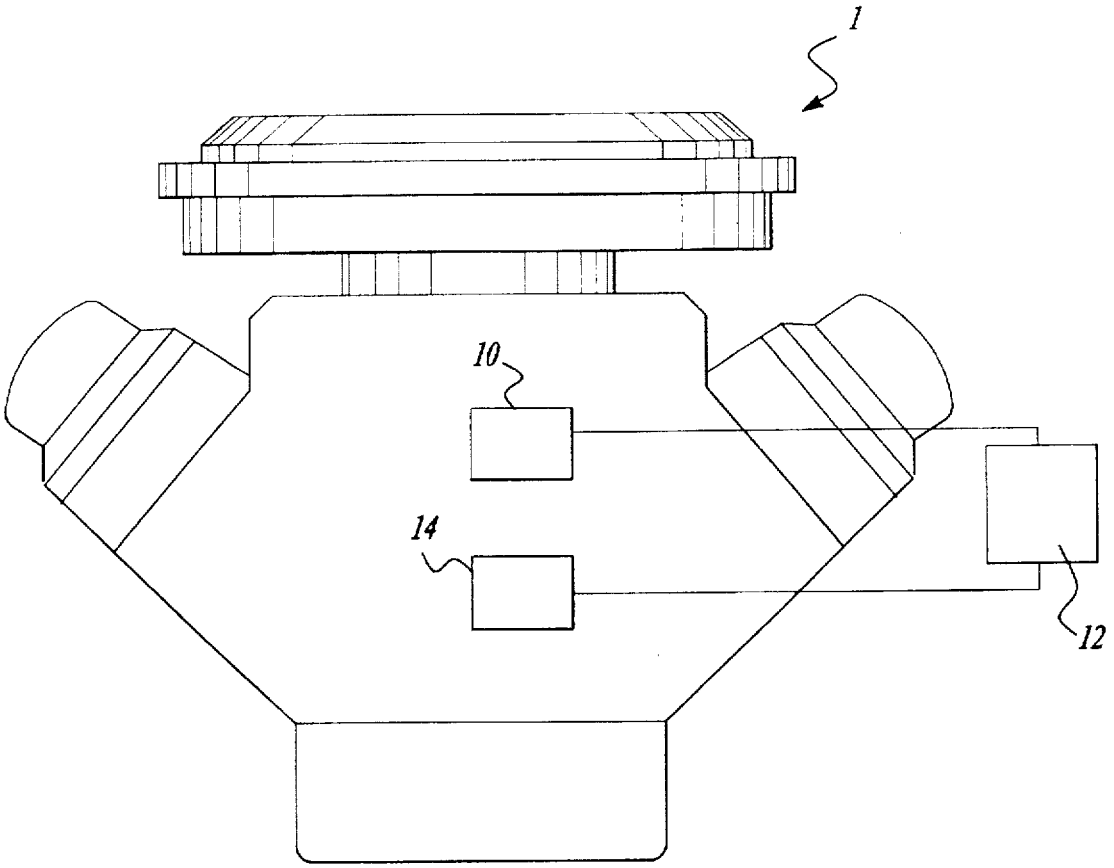
FIG. 1 is a schematic view of a system for controlling fuel scheduling in an internal combustion engine as a function of misfire rate according to the present invention.

In FIG. 1 a system for controlling the fuel scheduling within an internal combustion engine is shown generally at 1. According to the present invention, the amount of fuel pulsed into the combustion chambers (not shown) of the internal combustion engine 1 is periodically increased to protect the catalytic converter from thermal damage. Extra fuel is not added to the system in increased amounts until a sufficient level of misfiring has developed. Therefore, the operator does not suffer a fuel economy penalty by unnecessarily adding fuel to the system in the absence of a potentially damaging misfire condition. Also, the present invention allows the ratio of fuel to air to be incrementally increased as the misfire rate increases. Accordingly, activation of a message indicator lamp or warning signal may be postponed until a misfire rate develops which is closer to an actual damage threshold value.

Generally, when a misfire condition develops, unignited fuel and unused oxygen pass to the catalytic converter for combustion. The oxidation is reduced within the catalytic converter by increasing the ratio of fuel to air. Accordingly, the combustion in the catalytic converter occurs at lowered exothermic levels and the potential for thermal damage is reduced.

Still referring to FIG. 1, a misfire detector 10 is disposed on the engine 1 for detecting rates of misfire. As is generally known in the art, the misfire detector 10 can be configured to monitor crankshaft speeds in order to detect misfire conditions. An engine control unit (ECU) 12 electronically communicates with the misfire detector 10 for interpreting the signals from the misfire detector 10. The ECU 12 receives signals from the misfire detector 10 indicating the absence or presence of one or more misfire conditions. A more detailed explanation of misfire detection based on crankshaft angular velocity can be found in U.S. Pat. No. 5,361,629 to McCombie.

The ECU 12 also electronically communicates with the engine fuel system 14. The ECU 12 operates to control the ratio of fuel to air provided to the combustion chambers in the engine 1 by sending appropriate signals to the fuel system 14. Accordingly, the ECU 12 adjusts the fuel scheduling within the fuel system 14 according to the signals received from the misfire detector 10.

Figure 2:
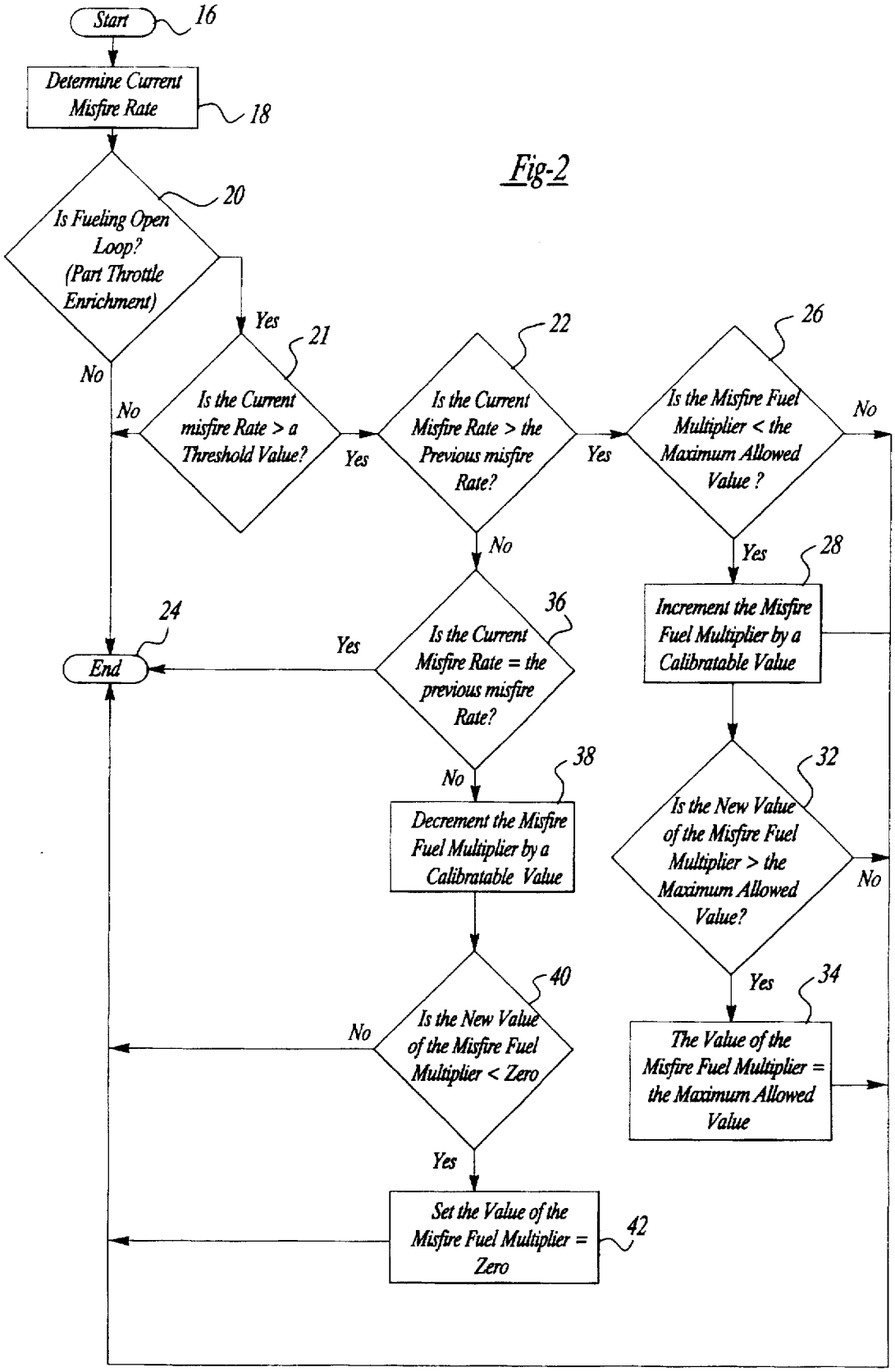
FIG. 2 is a flow chart depicting the fuel scheduling system methodology according to the present invention.

Referring now also to FIG. 2, the methodology for adjusting the fuel scheduling of the internal combustion engine 1 is shown in greater detail. The methodology enters at 16 and advances to a block 18 where the current misfire rate is determined. As described above, this is accomplished by the misfire detector 10 sensing misfire conditions and sending appropriate signals to the ECU 12 for further processing. As such, the methodology determines a current misfire rate at the block 18.

From the block 18, the methodology continues to a decision block 20 where the fuel system is checked to determine if it is in an open loop mode. This is generally accomplished by a throttle position sensor sensing the position of the throttle and sending an appropriate signal to the ECU 12. If the throttle position sensor signal indicates that the throttle position is equal to "wide open throttle" then the fuel system is deemed to be in an open loop mode. Open loop fuel control is also accomplished in defined regions of engine speed (RPM) and load (MAP) that may cause exhaust gas temperatures to exceed the maximum allowed temperatures causing engine or exhaust system components such as exhaust valves, turbochargers, or exhaust manifolds to exceed their maximum allowable temperatures. In these predefined regions, the fuel to air ratio is enriched just enough to prevent the engine and exhaust system components from exceeding their temperature limits. If the fuel system is in an open loop mode, the methodology advances from the decision block 20 to a pre-selected decision block 21 where the current misfire rate is compared to a threshold misfire rate. If the fuel system is not in an open loop mode, the methodology advances from the decision block 20 to 24 where it exits the routine.

If the current misfire rate is less than the threshold rate in the block 21, the methodology advances to 24 where it is exited from the routine. If the current misfire rate is greater than the threshold rate, the methodology continues to a decision block 22 where the current misfire rate is compared to the misfire rate determined during the last execution of the methodology. If the current misfire rate is greater than the last misfire rate, the methodology advances to a decision block 26 for application of a fuel misfire multiplier.

The fuel misfire multiplier serves to control the amount of fuel added to the system to thereby control the ratio of fuel to air. When the misfire fuel multiplier is increased, the ECU 12 operates to cause the amount of fuel in the fuel system 14 to be increased. Similarly, when the misfire fuel multiplier is decreased, the ECU 12 causes the amount of fuel in the fuel system 14 to be decreased. It should be noted that the maximum allowed ratio of fuel to air within the fuel system 14 is a function of engine RPM and load. Therefore, the ECU 12 adjusts the misfire fuel multiplier limit of the methodology accordingly. At lower RPMs and engine load, a lower limit is employed. At higher RPMs and engine load, a greater limit is used.

Referring again to the decision block 26, the current misfire fuel multiplier corresponding to the amount of fuel in the system is compared to the maximum allowed misfire fuel multiplier value. The maximum allowed value serves as a ceiling to prevent the ratio of fuel to air from exceeding a threshold ratio. If the current misfire fuel multiplier is less than the maximum allowed value, the methodology advances from the block 26 to a block 28, where the misfire fuel multiplier is incremented by a calibrated value. However, if the current misfire fuel multiplier value is equal to or greater than the maximum allowed value, the methodology advances to 24 where it exits the routine. Thus, only a ratio of fuel to air up to a maximum ratio is generated by the system.

From the block 28, the methodology continues to a decision block 32 where the new misfire fuel multiplier value is compared to the maximum misfire fuel multiplier value. If the new value of the misfire fuel multiplier is less than the maximum allowed value, the methodology continues to 24 where it is exited from the routine. However, if the new value of the misfire fuel multiplier is greater than the maximum allowed value, the methodology advances from the block 32 to a block 34 where the value of the new misfire fuel multiplier is set equal to the maximum allowed value. Accordingly, only a ratio of fuel to air which is less than the maximum allowed ratio is implemented. From the block 34, the methodology continues to 30 where it exits the routine.

Referring again to the decision block 22, if the current misfire rate is less than the previous misfire rate, the methodology advances to a decision block 36 for further processing. At the decision block 36, the current misfire rate is compared to the previous misfire rate. If the current misfire rate is equal to the previous misfire rate, no adjustment of the ratio of fuel to air is made. Therefore, the methodology advances to 24 and exits the routine. In this way, the fuel scheduling is only adjusted if the misfire rate changes between subsequent executions of the control methodology.

If the current misfire rate is not equal to the previous misfire rate at the decision block 36, the methodology advances to a block 38. At the block 38, the misfire fuel multiplier value is decremented by a calibrated value. In this way, a decrease in misfire rate is compensated for by decreasing the amount of fuel in the system. Thus, the operator does not suffer a fuel economy penalty by unnecessarily maintaining a ratio of fuel to air higher than that required for the current misfire rate.

From the block 38, the methodology advances to a decision block 40 where the new value of the misfire fuel multiplier is compared to a predetermined value, preferably zero. This step prevents the ratio of fuel to air from being decreased below a predetermined level corresponding to normal operating parameters. If the new value of the misfire fuel multiplier is greater than zero at the block 40, the methodology advances to 24 where it exits the routine. However, if the new value of the misfire fuel multiplier is less than zero, the methodology advances to a block 42 where the misfire fuel multiplier value is set equal to zero in order to effectuate a normal operating ratio of fuel to air. From the block 42, the methodology advances to 24 and exits the routine.

Preferably, the control methodology described above is executed periodically, most preferably, every 200 engine revolutions. At this rate, a sufficient time period has elapsed between executions for changes in misfire conditions to occur and be detected reliably but not so long that damage to the catalyst substrate is likely. Furthermore, it is preferable to determine misfire rates when the engine has reached a fully warm condition to ensure accuracy of detected rates. At fully warm conditions, the majority of system discrepancies which could cause false readings have occurred and are unlikely to interrupt the system.

Figure 3:
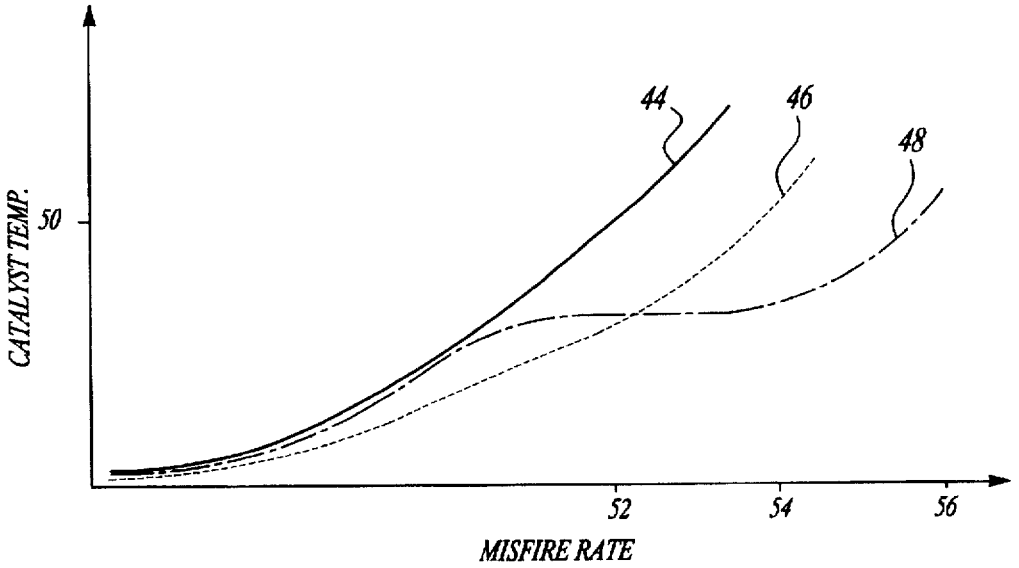
FIG. 3 is a graph showing the catalyst temperature as a function of misfire rate according to the prior art and the present invention.

Referring now to FIG. 3, a graph of catalyst substrate temperatures within the catalytic converter versus engine misfire rates is shown. As can be seen by the noncontrolled system curve 44, the temperature of the catalyst substrate quickly increases as misfire rates increase without adjusting the fuel scheduling. The system curve 44 quickly surpasses the damage temperature 50 and requires a very low setting 52 for activation of the warning signal.

The continuously controlled system curve 46 shows that the temperature of the catalyst substrate can be maintained at a relatively low level by operating at enriched levels regardless of the presence of a misfire condition. However, this system also quickly exceeds the damage threshold temperature 50 and requires an artificially low setting 54 for activating a warning signal. The continuous system 46 also causes the operator to suffer a fuel economy penalty by unnecessarily adding fuel at relatively low misfire rates. On the other hand, as can be seen by the incrementally controlled curve 48 representing the present invention, the temperature of the catalyst substrate is kept lower for a prolonged period of time. Accordingly, the damage point 50 is not reached until well after the prior art systems. Also, the set point 56 for activating a warning lamp is much closer to a damage threshold value. This is possible since the fuel scheduling can be adjusted to add additional amounts of fuel to compensate for increased misfire rates. Also, fuel is not added to the system until a predetermined level of misfire rate has developed. Therefore, the catalyst substrate is protected from thermal damage and the operator does not suffer a fuel economy penalty.

Thus, it can be appreciated from the foregoing that the present invention provides a system for controlling exothermic activity in the catalytic converter by adding fuel to the fuel system when a sufficient misfire rate develops. If the misfire rate continues to increase, additional fuel is added up to a predetermined level. If the misfire rate decreases, fuel is removed from the system. Thus, fuel is not unnecessarily added to the system in the absence of a misfire condition. Also, the maximum ratio of fuel to air is limited as a function of engine RPM and load.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A method of controlling exothermic activity in a catalytic converter comprising:

determining a misfire rate in an internal combustion engine;

comparing said determined misfire rate to at least one predetermined misfire rate; and adjusting a ratio of fuel to air a calibrated amount according to said determined misfire rate and said at least one predetermined rate, wherein said adjusting includes maintaining a fuel to air ratio at a current ratio when said determined misfire rate equals said at least one predetermined rate.

2. The method of claim 1 wherein said at least one predetermined rate is equal to a previously determined misfire rate.

3. The method of claim 1 further comprising:

decrementing said ratio of fuel to air when said determined misfire rate is less than said at least one predetermined rate and said ratio of fuel to air is greater than a minimum ratio.

4. The method of claim 3 wherein said minimum ratio of fuel to air is equal to a normal operating condition fuel to air ratio.

5. The method of claim 1 further comprising:

incrementing said ratio of fuel to air when said determined misfire rate is greater than said at least one predetermined rate and said ratio of fuel to air is less than a maximum ratio.

6. The method of claim 5 wherein said maximum ratio of fuel to air corresponds to engine speed and load.

7. The method of claim 1 wherein said comparing step further comprises:

comparing said determined misfire rate to a threshold misfire rate prior to comparing said determined misfire rate to a previously determined misfire rate.

8. The method of claim 7 wherein said comparison of said determined misfire rate to a previously determined misfire rate is only made if said determined misfire rate is greater than said threshold misfire rate.

9. The method of claim 1 wherein said comparing step is executed after a fuel system of said internal combustion engine is in an open-loop mode.

10. The method of claim 1 wherein said comparing step is executed every predetermined number of engine revolutions.

11. The method of claim 10 wherein said predetermined number of engine revolutions is in the range of 175–225 engine revolutions.

12. The method of claim 1 wherein said determining step is executed after said internal combustion engine reaches a fully warm condition.

13. A method of controlling catalyst substrate temperatures comprising:

determining a rate of misfire in an internal combustion engine;

comparing said determined rate of misfire to a previously determined misfire rate;

incrementing a ratio of fuel to air a calibrated amount when said determined rate of misfire is greater than said previously determined rate of misfire and said ratio of fuel to air is less than a maximum ratio;

decrementing said ratio of fuel to air a calibrated amount when said determined misfire rate is less than said previously determined rate of misfire and said ratio of fuel to air is greater than a minimum ratio; and maintaining said fuel to air ratio at a current ratio when said determined misfire rate equals said previously determined rate.

14. The method of claim 13 further comprising activating a warning when said determined rate of misfire is greater than or equal to a pre-selected rate of misfire.

15. The method of claim 13 wherein said determining of said rate of misfire occurs after a given amount of engine revolutions.

16. The method of claim 15 wherein said given amount of engine revolutions is in the range of 175–225 engine revolutions.

17. The method of claim 13 wherein said comparing step is executed after said determined misfire rate exceeds a threshold misfire rate.

18. The method of claim 13 wherein said comparison step is executed after a fuel system of said internal combustion engine is in an open-loop mode.

19. The method of claim 13 wherein said maximum ratio of fuel to air corresponds to engine speed and load.

20. The method of claim 13 wherein said minimum ratio is equal to a normal operating condition fuel to air ratio.

21. The method of claim 13 wherein said determining step is executed after said internal combustion engine reaches a fully warm condition.

22. A method of controlling a ratio of fuel to air in an internal combustion engine from a normal operating ratio to an adjusted operating ratio comprising:

determining a rate of misfire after a given amount of engine rotations;

comparing said determined rate of misfire to a last determined rate of misfire;

incrementing said ratio of fuel to air a calibrated amount when said determined rate of misfire is greater than said last determined rate of misfire and said ratio of fuel to air is less than a maximum ratio;

setting said ratio of fuel to air to said maximum ratio if said incremented ratio of fuel to air is greater than said maximum ratio;

decrementing said ratio of fuel to air when said determined misfire rate is less than said last determined misfire rate and said ratio of fuel to air is greater than a minimum ratio; and setting said ratio of fuel to air to said minimum ratio if said decremented ratio of fuel to air is less than said minimum ratio.

23. The method of claim 22 further comprising:

activating a warning when said determined rate of misfire is greater than or equal to a pre-selected rate of misfire.

24. The method of claim 22 wherein said comparison step is executed after said determined misfire rate exceeds a threshold misfire rate.

25. The method of claim 22 wherein said comparison step is executed after a fuel system of said internal combustion engine is in an open-loop mode.

26. The method of claim 22 wherein said maximum fuel to air ratio corresponds to engine speed and load.

27. The method of claim 22 wherein said minimum fuel to air ratio is equal to a normal operating condition fuel to air ratio.

28. The method of claim 22 wherein said given amount of engine rotations is in the range of 175 to 225 engine rotations.

29. The method of claim 22 wherein said determining step is executed after said internal combustion engine reaches a fully warm condition.

30. The method of claim 22 further comprising maintaining said fuel to air ratio at a current ratio when said determined misfire rate equals said last determined misfire rate.

* * * * *